US005233334A

United States Patent [19]

Takebe et al.

[11] Patent Number: 5,233,334

[45] Date of Patent: * Aug. 3, 1993

[54] TEXT DISPLAY APPARATUS AND A METHOD OF DISPLAYING TEXT

[75] Inventors: Hideharu Takebe, Hyogo; Akihiko Ishimoto, Osaka, both of Japan

[73] Assignee: Mitsubishi Denki Kabushiki Kaisha, Tokyo, Japan

[ * ] Notice: The portion of the term of this patent subsequent to Jul. 13, 2010 has been disclaimed.

[21] Appl. No.: 643,951

[22] Filed: Jan. 22, 1991

[30] Foreign Application Priority Data

Jan. 30, 1990 [JP] Japan ..... 2-21657

[51] Int. Cl.[5] ..... G09G 3/02

[52] U.S. Cl. ..... 340/735; 340/709; 340/812

[58] Field of Search ..... 340/735, 750, 717, 784, 340/716, 720, 811, 812, 790, 731, 735, 709; 395/162, 150, 151

[56] References Cited

U.S. PATENT DOCUMENTS

| | | | |
|---|---|---|---|
| 3,803,584 | 4/1974 | Hittel | 340/717 X |
| 4,429,306 | 1/1984 | McCauley et al. | 340/735 X |
| 4,439,762 | 3/1984 | Van Vliet et al. | 340/735 X |
| 4,441,105 | 4/1984 | Van Vliet et al. | 340/717 X |
| 4,740,783 | 4/1988 | Lawrence et al. | 340/735 X |
| 4,760,387 | 7/1988 | Ishii et al. | 340/717 X |
| 4,855,728 | 8/1989 | Mano et al. | 340/717 X |

FOREIGN PATENT DOCUMENTS

| | | |
|---|---|---|
| 0259827 | 9/1987 | European Pat. Off. . |
| 0295692A3 | 6/1988 | European Pat. Off. . |

OTHER PUBLICATIONS

Scott Mueller, "Upgrading and Repairing PCs", Que Corp., 1988, pp. 442–443.

Pega 2, Paradise Systems, Inc., South San Francisco, Calif., 1986, pp. 7, 12, 13, 15.

*Primary Examiner*—Ulysses Weldon

*Attorney, Agent, or Firm*—Lowe, Price, LeBlanc & Becker

[57] ABSTRACT

In a text display apparatus comprising a display panel having the display resolution fixed, and a program for carrying out text display by the standard character size corresponding to the display resolution of the display panel, a text display apparatus displaying one page of text in the entire area of the screen with a character size different from the standard character size without modifying the application program, and a method of displaying text are disclosed. The text display apparatus in accordance with the present invention comprises an input source circuit for reading out character code data from a text storing medium, a first character specifying circuit for specifying the standard character size, a second character size specifying circuit for specifying a character size different from the standard character size, a refresh memory for storing the character code data, a selector for selecting the character size specified in the second character size specifying circuit when one page of text can not be displayed on the entire area of the screen with the standard character size, character generating circuit for generating character font data of the character size selected by the selector.

18 Claims, 6 Drawing Sheets

TEXT DISPLAY APPARATUS AND A METHOD OF DISPLAYING TEXT

BACKGROUND OF THE INVENTION

1. Field of the Invention

The present invention relates to text display apparatus displaying text on the screen of the display means having the resolution fixed, and more particularly, to a text display apparatus that can display characters of one text page on the full area of the screen, and a method of displaying the text thereof.

2. Description of the Background Art

Recently, improvement in display resolution and reduction in cost are seen in liquid crystal display panels and personal display panels or the like. Also in the field of personal computers, portable types have been developed.

There are many kinds of software in the market used in personal computers, including those developed in the past. However, the resolution of the display screen corresponding to the software developed in the past is generally lower than that of the display screen corresponding to the newly developed software in accordance with the advance in the technique of the display medium. In the case of displaying text, the display character size corresponding to the software developed in the past is small compared with that of the newly developed softwares. When one page of text is displayed using a newly developed display panel, which is generated by a software having a text display screen with a resolution of the display panel lower than that of the newly developed display panel, the display area will be smaller than the screen size of the display panel. This results in a non-display area in the screen, leading to the inconvenience that the entire screen is not used efficiently.

FIG. 7 is a diagram for explaining the development of a non-display area. When one page of text (character size 8×8 dots, 80×25 lines) set to correspond to a display panel of 640×200 dots developed in the past is displayed using a display panel having a display resolution of 640×480 dots, the display area is 5/12 of the entire screen, and the remaining 7/12 of the entire screen is a non-display area.

The method of storing character font data other than 8×8 dots, for example, character font data of 8×19 dots, in a character generator, and building a program specifying the character size of 8×19 dots is considered to display text on the entire screen.

However, the specification of the character size is carried out by the kernel package (referred to as an application program hereinafter) for character display corresponding to the resolution of the display panel. The application program corresponds to the resolution of the newly developed display panel. The compatibility of the application program prevents rewriting from the user side of the manufacturers of personal computers and word processors. The contents of the program are not disclosed and are kept private.

SUMMARY OF THE INVENTION

In view of the foregoing, an object of the present invention is to provide a text display apparatus that can display text of various sizes in the entire area of the screen without modifying the application program.

A further object of the present invention is to inhibit the rewriting of the character size in a text display apparatus when a character size is specified that differs from the character size specified by the application program.

A still further object of the present invention is to provide a method of displaying text of various sizes in the entire area of the screen without modifying the application program.

In summary, a text display apparatus in accordance with the present invention comprises a display panel having the display resolution fixed, a first character size specifying circuit, a second character size specifying circuit, an input source circuit, a select circuit, a display line address generating circuit, a refresh memory, a character generating circuit, and a video signal generating circuit. The first character size specifying circuit specifies the standard character size corresponding to the display resolution of the display panel. The second character size specifying circuit specifies a character size that differs from the standard character size. The input source circuit reads out the character code data of one page of text and the address data of the character position from the text display medium. The read out data is used to make the determination as to whether the entire area of the display panel screen can be displayed with the standard character size. The select circuit selects the first character size specifying circuit when the determination output is affirmative, and the second character size specifying circuit when the determination output is negative. The display line address generating means generates display line address data for displaying text. The refresh memory stores the read out character code data, and outputs the same in response to the display line address data. The character generating circuit is responsive to the character code data from the refresh memory to generate the character font data of the character size selected by the select circuit. The video signal generating circuit generates video signals in accordance with the character font data generated from the character generating circuit.

In operation, the character size data that can display one page of text in the entire area of the screen is written into the second character size specifying circuit, when one page of text with a character size different from the standard character size (the character size by the application program) is to be displayed on the entire area of the display panel screen. Next, the second character size specifying circuit is selected by the select circuit. The character size of the character font data generated by the character generating circuit is specified by this selected character specifying circuit. This character font data is applied to the video signal generating circuit. By converting the character font data into video signals in the video signal generating circuit, one page of text to be displayed is displayed in the entire area of the display screen.

In accordance with the present invention, text can be displayed on the entire screen of the display means without degrading the compatibility of the application program, by setting a character size that differs from the character size set by the application program.

The foregoing and other objects, features, aspects and advantages of the present invention will become more apparent from the following detailed description of the present invention when taken in conjunction with the accompanying drawing.

DESCRIPTION OF THE PREFERRED EMBODIMENTS

Figure 1:
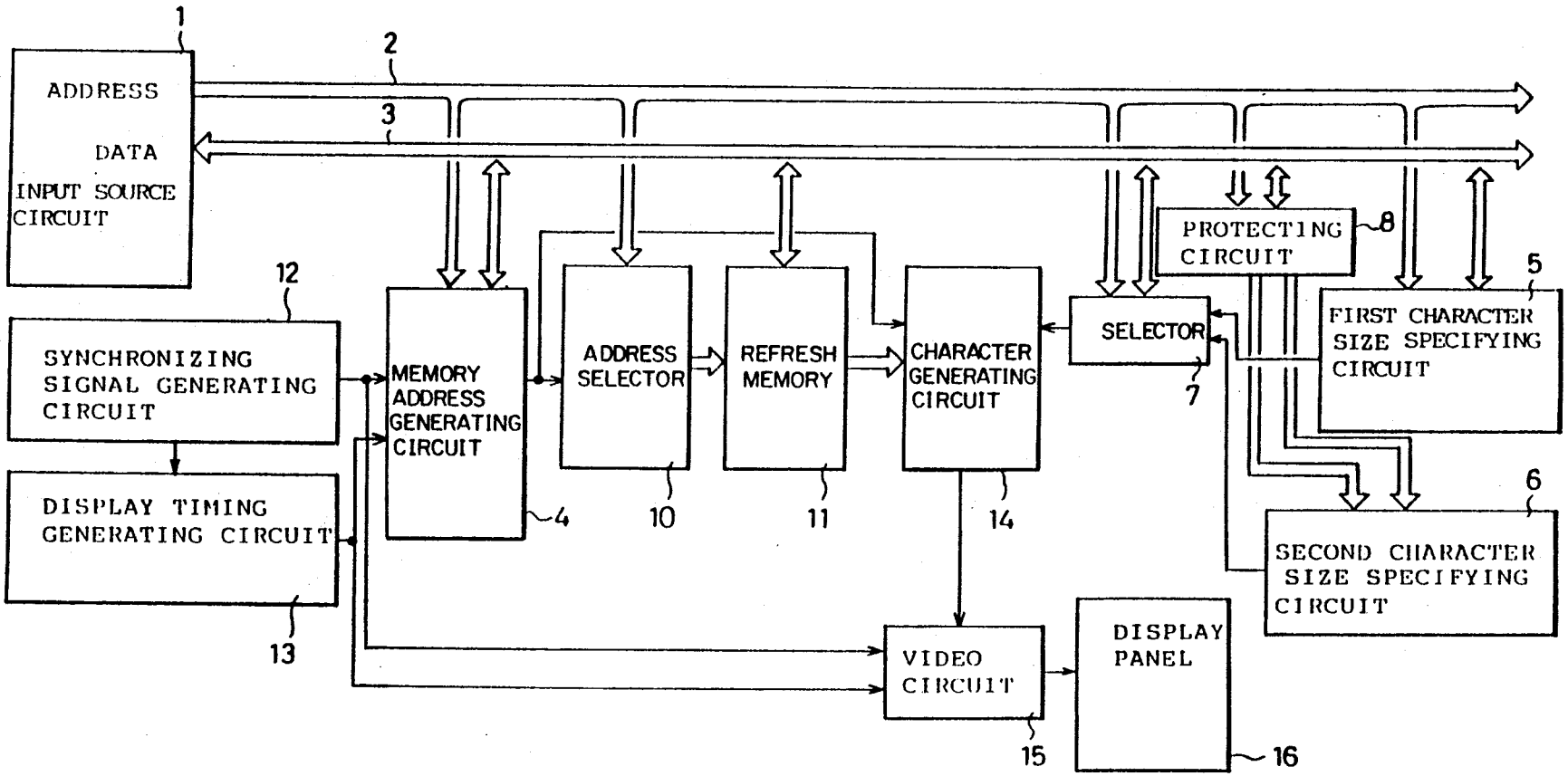
FIG. 1 is a block diagram showing an embodiment of a text display apparatus in accordance with the present invention.
Figure 2:
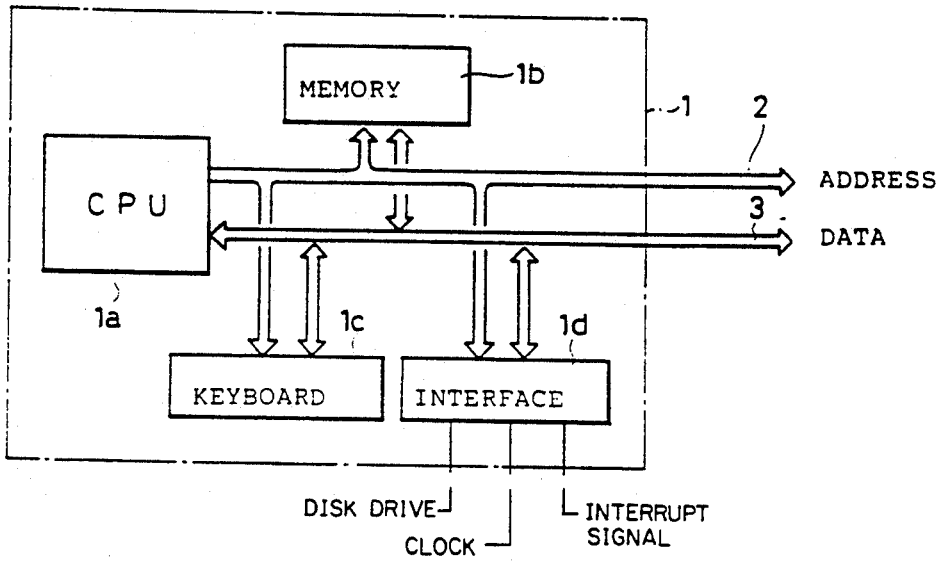
FIG. 2 is a block diagram of an input source circuit.
Figure 3:
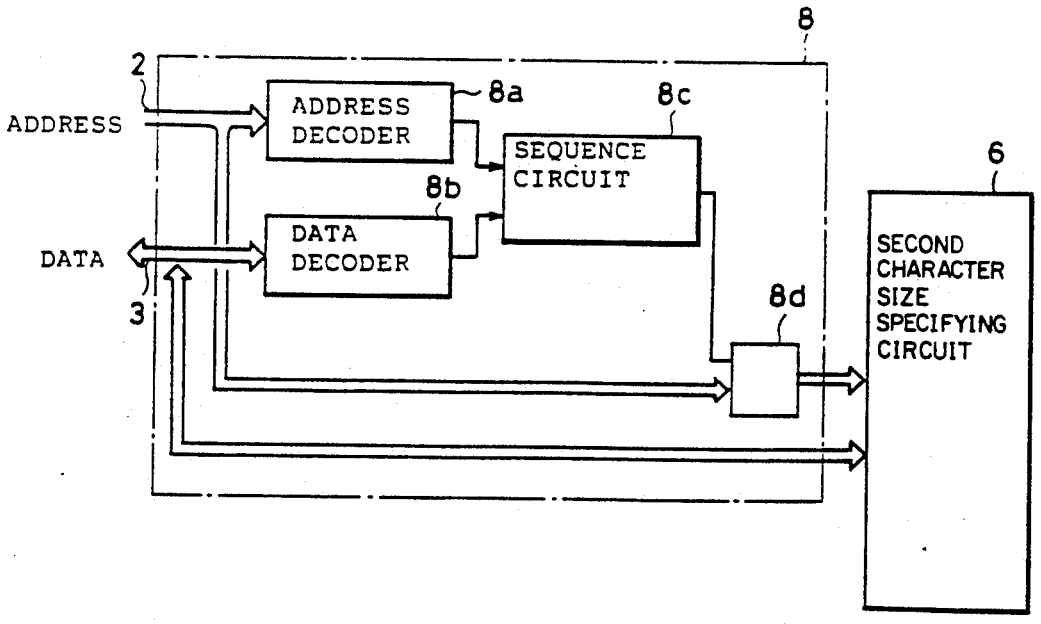
FIG. 3 is a block diagram of a protecting circuit.
Figure 4:
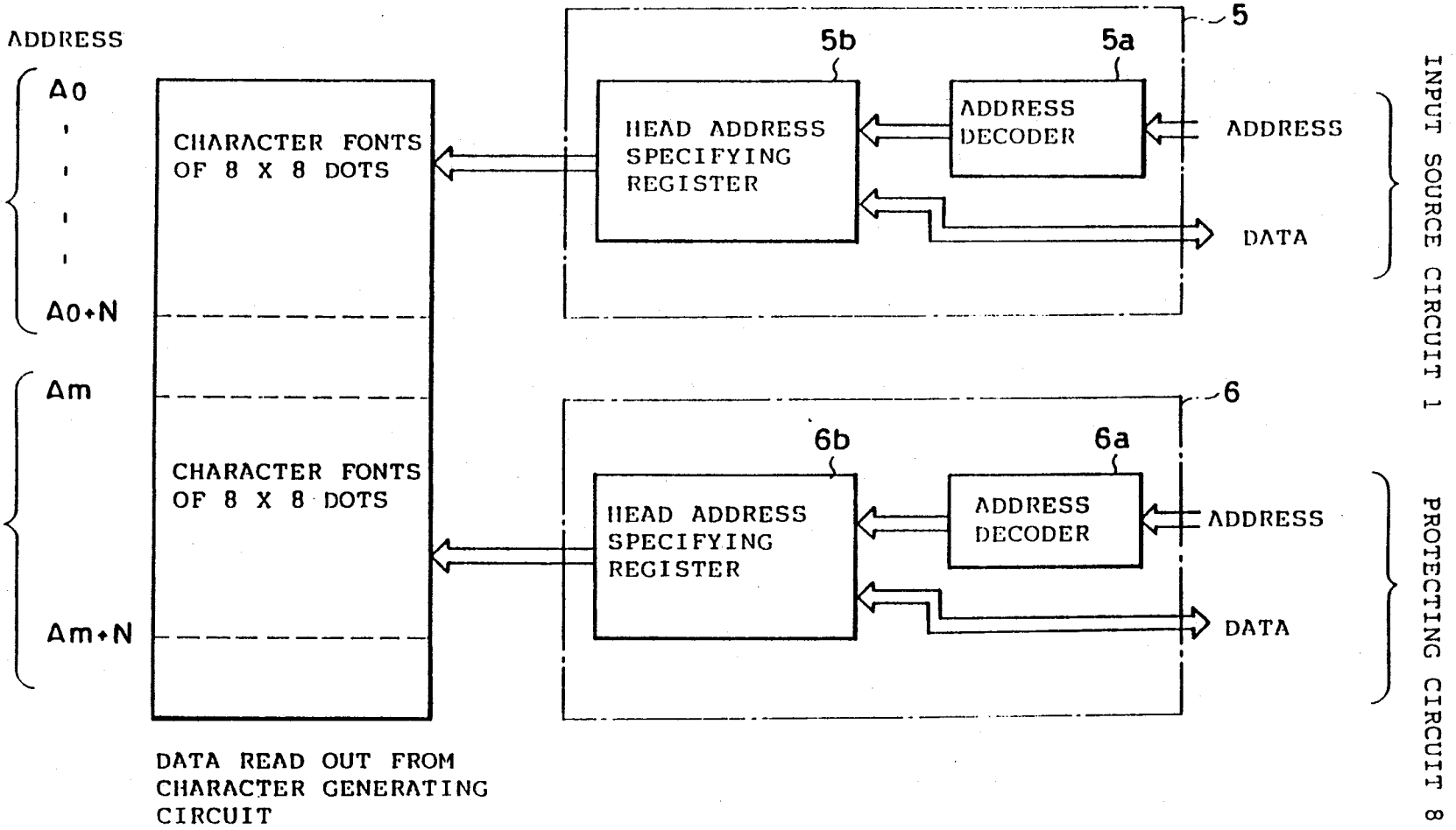
FIG. 4 is a block diagram for explaining the relationship between the first and second character size specifying circuits and the character generating circuit.

FIG. 1 is a block diagram of a personal computer used as a text display apparatus, whereas FIGS. 2, 3, and 4 are block diagrams showing the respective circuits of FIG. 1 in detail.

Referring to FIG. 1, an address bus 2 and a data bus 3 are connected to an input source circuit 1, a memory address specifying circuit 4, a first character size specifying circuit 5, a selector 7 selectively making the first character size specifying circuit 5 and the second character size specifying circuit 6 effective, and a protecting circuit 8. An address selector 10 is connected to address bus 2, while a refresh memory 11 is connected to data bus 3.

Input source circuit 1 as shown in FIG. 2 comprises a CPU 1a, a memory 1b, a keyboard 1c, and an interface 1d for inputting/outputting interrupt signals and the like from a clock, a disk drive, and a light pen. Interface 1d is operatively coupled to the text storing medium by magnetic or photocoupling pen.

CPU 1a controls memory 1b, keyboard 1c, and interface 1d. Memory 1b stores an application program for displaying text of a certain standard corresponding to the display resolution of the display panel on the entire area of the screen, and a program including the application program for displaying text of a standard different from the predetermined standard on the entire area of the screen.

Input source circuit 1 applies character train code data of one page of text read out from interface 1d and address data to memory address generating circuit 4, the first character size specifying circuit 5, selector 7, and protecting circuit 8, through data bus 3 and address bus 2. The address data generated by input source circuit 1 is applied to an address selector 10, whereas the character code data is applied to refresh memory 11.

Memory address generating circuit 4 and video circuits receive synchronizing signals from a synchronizing signal generating circuit 12. Memory address generating circuit 4 also receives and signals from a display timing generating circuit 13, to convert the address data provided from input source circuit 1 into an address data corresponding to the display position of a display panel 16 such as a liquid crystal panel or plasma display panel. In other words, address data for specifying the line and column are generated and applied to an address selector 10 and a character generating circuit 14.

Address selector 10 is responsive to the writing/reading from input source circuit 1 to select address data from input source circuit 1, whereby the selected address data is applied to refresh memory 11. Refresh memory 11 writes character code data of one page of text in accordance with the address data provided from address selector 10. When displaying characters, address selector 10 selects display address data from memory address generating circuit 4 and provides the same to refresh memory 11. In response to the address data for display, refresh memory 11 provides the stored character code data to character generating circuit 14. The code data in this case is address data indicating the type of character, whereby the type of the character to be displayed is specified by this address data.

Referring to FIG. 3, protecting circuit 8 comprises an address decoder 8a, a data decoder 8b, a sequence circuit 8c, and an AND circuit 8d. Circuit 8 allows the writing of the character size from the input source circuit 1 to the second character size specifying circuit 6 when the character size suiting the resolution is specified. More specifically, the output of address decoder 8a is at "H" only when the address data of protecting circuit 8 and the address data of the second character size specifying circuit 6 are input from input source circuit 1, and otherwise at "L". The output of data decoder 8b is at "H" only when a particular data for releasing protecting circuit 8 is input, and otherwise at "L". The output of sequence circuit 8c is at "H" when the output of address decoder 8a is "H" and when the output of data decoder 8b is "H" two times in succession. The output of sequence circuit 8c immediately becomes "L" when the output of address decoder 8a is "L". Therefore, the address data of the second character size specifying circuit 6 passes AND circuit 8d only immediately after particular data is written two times in succession to protecting circuit 8. The second character size specifying circuit can be specified by the address data passing AND circuit 8d, whereby character size data can be written into the second character size specifying circuit 6. The writing into the second character size specifying circuit 6 is inhibited when address data other than of protecting circuit 8 or of the second character size specifying circuit 6 is specified by input source circuit 1, with the result that the output of sequence circuit 8c becomes "L".

Protecting circuit 8 is to be released when the output of data decoder 8b is "H" two times in succussion. The purpose of this is to ensure the inhibition of character size data being written into the second character size specifying circuit 6 by the application program when the system is turned on. However, if speed is required more than reliability, protecting circuit 8 may be made to be released when the output of data decoder 8b is "H" one time.

FIG. 4 is a block diagram showing the relationship between the first and second character size specifying circuits 5 and 6 and character generating circuit 14. Referring to FIG. 4, the first character size specifying circuit 5 and the second character size specifying circuit 6 comprise address decoders 5a and 6a, and head address specifying registers 5b and 6b, respectively. Address decoder 5a of the first character size specifying circuit 5 decodes address data from input source circuit 1 and provides the decoded address data to head address specifying register 5b. This causes data $A_0$ of the character size from input source circuit 1 to be written into head address specifying register 5b. Data $A_0$ is the head address of the character to be read out from character generating circuit 14, and is provided to character generating circuit 14 through selector 7. Address decoder 6*a* of the second character size specifying circuit 6 decodes address data from protecting circuit 8 and provides the same to head address specifying register 6*b*. This causes data $A_m$ of character size from input source circuit 1 to be written into head address specifying register 6*b*. Data $A_m$ is the head address of the character to be read out from character generating circuit 14, and is provided to character generating circuit 14 through selector 7. Thus, the character size in one page of text is written into the first character size specifying circuit 5 by the application program of input source circuit 1. The character size for displaying one page of text on the entire screen of display panel 16 is written into the second character size specifying circuit 6 by input source circuit 1 when the system is turned on.

Character generating circuit 14 comprises a ROM having character font data (dot pattern) stored in a plurality of sizes, so that the head addresses $A_0$ or $A_m$ (character size) is specified by the first or second character size specifying circuits 5 or 6 selected by selector 7. Then the type of the character is specified by the character code from refresh memory 11. Next, the line is specified by the address from memory address generating circuit 4. The address of O-N in the figure is the address specified by refresh memory 11 and memory address generating circuit 4. In accordance with the head address data, the type of the character, and the row address data, the stored character font data is provided to video circuit 15. The contents stored in character generating circuit 14 is described more specifically hereinafter. Various sizes of character patterns such as 8×8-dot character fonts and 8×19 dot character fonts are stored in character generating circuit 14. Among the stored character patterns, the 8 ×8-dot size is the character size to be set by the application program. The character font of 8×19-dot is used when the character font of 8×8-dot (display resolution of 640×200 dots, 80×25 characters/page) is displayed on the entire screen of the display panel 16 (640×480 dots) of the present inventive apparatus. This allows the display of text of 80×25 characters in 640×475 dots. The aforementioned character size is only by way of example and other character sizes may be stored corresponding to various text.

Figure 5:
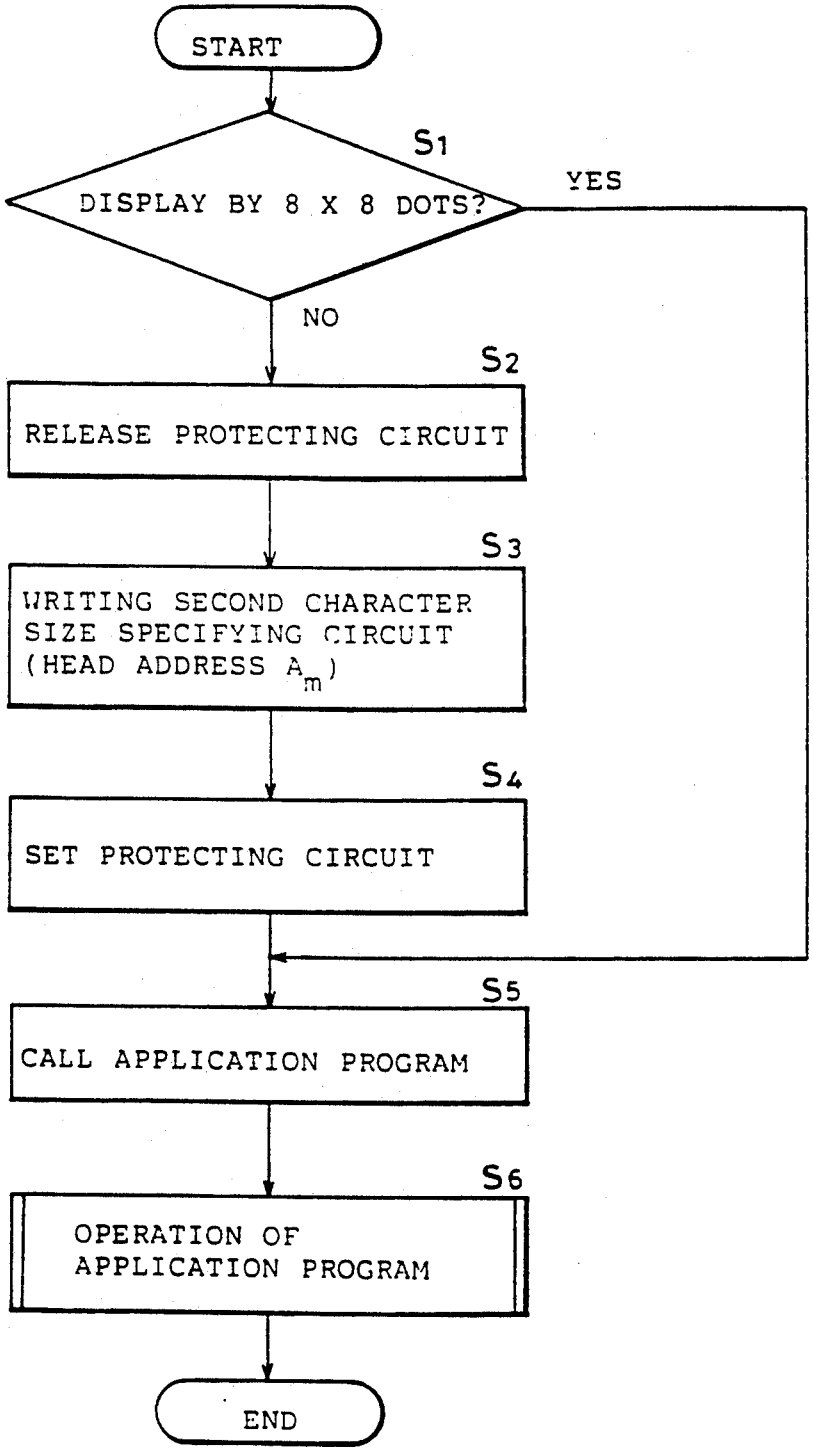
FIG. 5 is a flow chart for explaining the operation of the text display apparatus of FIG. 1.

The operation of the text display apparatus of FIG. 1 is described with reference to the flow chart of FIG. 5. In the present operation, an example is taken where the text according to a software of 640×200-dot display resolution, 8×8-dot character, 80×25 characters/page is displayed using a 640×480-dot display panel 16 with 8×19 dots and 80×25 characters. In step S1, input source circuit 1 fetches one page of text and makes the determination whether to display the character in 8×8-dot size or in 8×19-dot size. When determination is made that the character is to be displayed in 8×8-dot size, the application program is called in step S5. If determination is made that the character is to be displayed in 8×19-dot size, data such as character size data is provided to protecting circuit 8 for specifying the second character size specifying circuit 6 to the 8×19-dot size for releasing protecting circuit 8 in step S2.

In step S3, the character size data from input source circuit 1 for specifying the 8×19-dot size is written into the second character size specifying circuit 6.

In step S4, protecting circuit 8 is set to inhibit writing into the second character size specifying circuit 6, after the character size data is written into the second character size specifying circuit 6.

In step S5, the application program is called.

In step S6, the application program is operated. In other words, data of one page of text is written into refresh memory 11 according to the application program. In response to this written character train data, character generating circuit 14 generates character font data of 8×19-dot size.

The aforementioned application program is a program for reading out character font data of 8×8-dot size. However, in step S3 the second character size specifying circuit 6 specifies the head address as $A_m$ for the purpose of reading out 8×19-dot size character font data from character generating circuit 14. Therefore, the character font data read out in accordance with the address from refresh memory 11 and the line address from memory address specifying circuit 4 is the 8×19-dot size. The read out character font data is applied to video circuit 15.

Figure 6A:
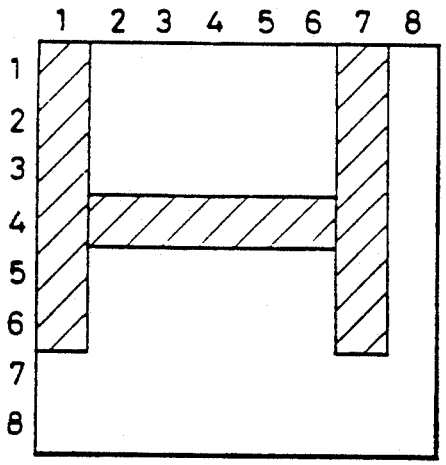
FIG. 6A is a diagram showing an example of a 8×8-dot size character and FIG. 6b is a diagram showing an example of a 8×19-dot size character.
Figure 6B:
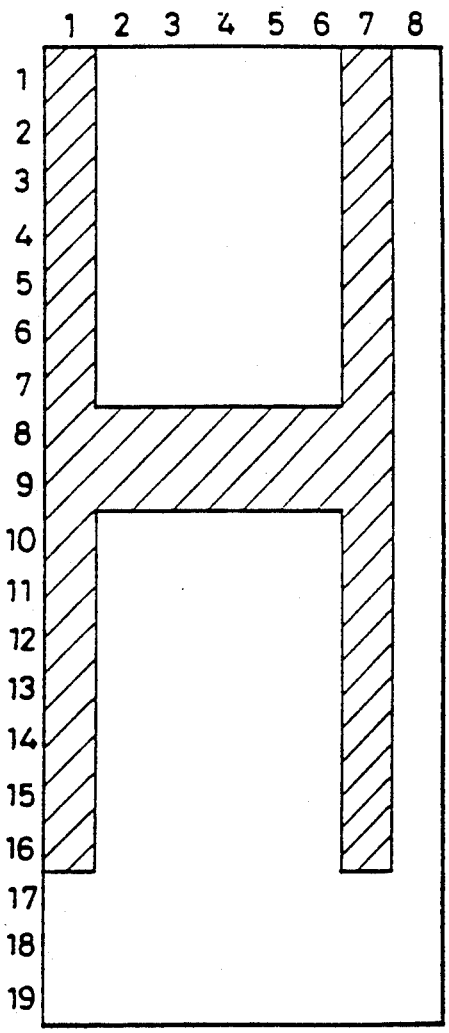
Figure 7:
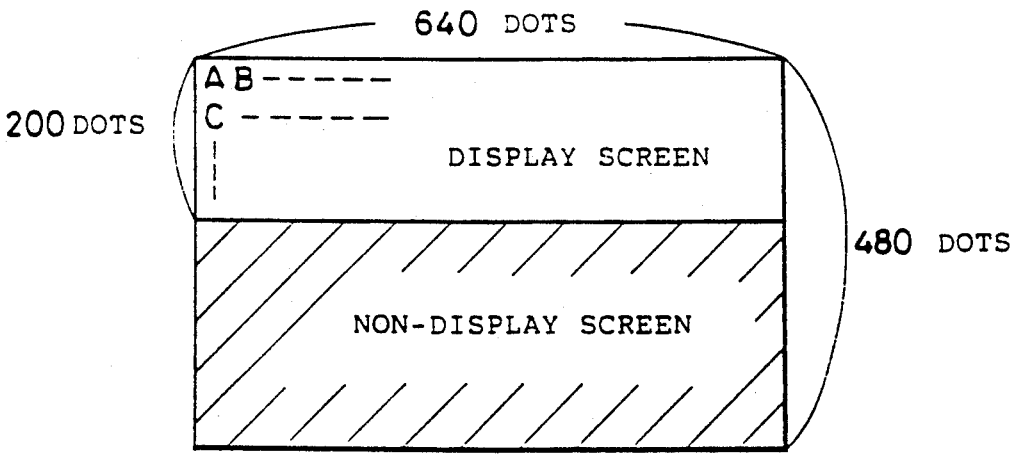
FIG. 7 is a diagram for explaining the increase of the non-display area in a conventional text display apparatus.

Video circuit 15 parallel/serial converts the character font data provided from character generating circuit 14 and provides the same to the display panel line-by-line. Display panel 16 displays characters line-by-line in accordance with the signal applied from video circuit 15 to terminate one page of text when 25 lines are displayed. The size of one character in this case is increased from 8 dots (FIG. 6(*a*)) to 19 dots (FIG. 6(*b*)) in the vertical direction.

Thus, one page of text of 80×25 characters can be displayed fully on the screen of a 640×480-dot display resolution.

Although the case where the character size is modified in the vertical direction (8 dots→19 dots) has been explained in the above embodiment, the present invention is also efficient in the case where the character size is expanded in the horizontal direction. For example, the resolution in the horizontal direction is 640 dots, when 80 characters of a 8×8-dot character pattern are aligned in the horizontal direction with the application program. In the case where a display panel having resolution of 720 dots in the horizontal direction is used, there will be a surplus of 80 dots. By specifying the font size of 9×8 dots in the character size specifying circuit 6, the character display on the display panel will be 9 dots×80 characters=720 dots, to fill the display panel also in the horizontal direction. As in the foregoing, the present invention is also applicable to expand the character size in the horizontal direction.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A text display apparatus comprising:

display means having a fixed display resolution, first character size specifying means for specifying the standard character size corresponding to the display resolution of said display means, second character size specifying means for specifying a second character size, different from the said standard character size, read out means for reading out character code data of one page of text and address data of the character position from a text storing medium, determination means for determining whether the read out character code data of one page of text can be displayed on the entire area of a screen of said display means with said standard character size, selecting means for selecting the first character size specifying means when the determination output of said determination means is affirmative, the second character size specifying means when the determination output is negative, display line address generating means for generating display line address data to display text, memory means coupled to said display line address generating means for storing said read out character code data and providing and character code data in response to said display line address data, character generating means responsive to the character code data from said memory means for generating character font data of the character size selected by said selecting means, said character generating circuit comprising a read only memory having character font data of said standard character size stored at a first plurality of addresses and character font data of said second character size, different from said standard character size, stored at a second different plurality of addresses, and video signal means for generating and displaying a video signal corresponding to the character font data generated by said character generating means.

2. The text display apparatus according to claim 1, wherein said display means comprises a liquid crystal panel.

3. The text display apparatus according to claim 1, wherein said display means comprises a plasma display panel.

4. The text display apparatus according to claim 1, wherein said first character size specifying means comprises address decoder means, and head address specifying register means in which standard character size is written.

5. The text display apparatus according to claim 1, wherein said second character size specifying means comprises address decoder means and head address specifying means in which a character size different from the standard character size is written.

6. The text display apparatus according to claim 1, wherein said read out means comprises control means, interface means for operatively coupling to the text storing medium, and memory means storing the application program for displaying text with the standard character size on the display means.

7. The text display apparatus according to claim 6, wherein said operative coupling comprises magnetic coupling.

8. The text display apparatus according to claim 6, wherein said operative coupling comprises photo coupling.

9. The text display apparatus according to claim 1, wherein said read out means and determination means comprise CPU, memory, and interface means.

10. The text display apparatus according to claim 1, wherein said display address generating means comprises synchronizing signal generating means, display timing signal generating means for generating display timing signal in response to the synchronizing signal, and means for generating address data for display indicating the line number and column number, in accordance with the display timing signal and the address data indicating the display position of the character.

11. The text display apparatus according to claim 1, wherein said memory means comprises a refresh memory storing character code data.

12. The text display apparatus according to claim 1, wherein said character generating means comprises a ROM storing character font data of a plurality of different sizes.

13. The text display apparatus according to claim 1, wherein said video signal generating means parallel/serial converts character font data.

14. The text display apparatus according to claim 10, wherein said video signal generating means and said display line address generating means are coupled, and said video signal generating means parallel/serial converts the character font data for generating the corresponding video signal.

15. The text display apparatus according to claim 1, wherein said second character size specifying means comprises protecting means for releasing writing of character size in response to an address signal, and inhibiting the writing of the character size after the character size is written.

16. The text display apparatus according to claim 15, wherein said protecting means comprises address decoder means, data decoder means, and sequential means for passing character size data when the output of address decoder means and the output of data decoder means are applied.

17. The text display apparatus according to claim 13, wherein said video signal generating means and said display line address generating means are coupled, and said video signal generating means is responsive to a display timing signal for generating a video signal.

18. In a text display apparatus comprising, display means having a fixed resolution, first character size specifying means for specifying the standard character size corresponding to the display resolution of said display means, second character size specifying means for specifying a character size different from said standard character size, display address generating means for generating display address data to display text, refresh memory means, character generating means storing character font data of a plurality of different sizes, and video signal generating means for generating a video signal in accordance with character font data from character generating means, said character generating circuit comprising a read only memory having character font data of said standard character size stored at a first plurality of addresses and character font data of said second character size, different from said standard character size, stored at a second different plurality of addresses, a method of displaying text comprises the steps of:

reading out character code data of one page of text and address data of the character position from a text storing medium, determining whether or not the read out character code data can be displayed on the entire area of a screen of said display means with said standard character size, selecting the first character size specifying means when the determination output is affirmative, and selecting the second character size specifying means when the determination output is negative, providing the read out character code data and the address data of the character position into the refresh memory, providing address data for display into the refresh memory means, and generating character font data corresponding to the selected character size.

* * * * *